US011828141B2

(12) United States Patent
Jarratt et al.

(10) Patent No.: US 11,828,141 B2
(45) Date of Patent: Nov. 28, 2023

(54) OIL WELL TOOL SYSTEM AND APPARATUS

(71) Applicant: FREEDOM CHEMICAL TECHNOLOGIES, LLC, Midland, TX (US)

(72) Inventors: Jonathan D. Jarratt, Midland, TX (US); Charles H. Dietz, Midland, TX (US); John L Minor, Midland, TX (US); Tommy L. Roland, Midland, TX (US)

(73) Assignee: Freedom Chemical Technologies, LLC, Midland, TX (US)

( * ) Notice: Subject to any disclaimer, the term of this patent is extended or adjusted under 35 U.S.C. 154(b) by 0 days.

(21) Appl. No.: 16/961,498

(22) PCT Filed: Jan. 10, 2019

(86) PCT No.: PCT/US2019/013083

§ 371 (c)(1),
(2) Date: Jul. 10, 2020

(87) PCT Pub. No.: WO2019/140111

PCT Pub. Date: Jul. 18, 2019

(65) Prior Publication Data

US 2020/0340334 A1 Oct. 29, 2020

Related U.S. Application Data

(60) Provisional application No. 62/615,898, filed on Jan. 10, 2018.

(51) Int. Cl.
*E21B 43/08* (2006.01)
*E21B 17/042* (2006.01)

(52) U.S. Cl.
CPC ..... *E21B 43/084* (2013.01); *E21B 17/042* (2013.01); *E21B 43/086* (2013.01)

(58) Field of Classification Search
CPC ..... E21B 43/084; E21B 43/086; E21B 43/08; E21B 43/25
See application file for complete search history.

(56) References Cited

U.S. PATENT DOCUMENTS 2,005,631 A * 6/1935 Pace ..... F16L 15/001 285/333
2,344,909 A * 3/1944 Williams ..... E21B 43/088 166/234

(Continued)

FOREIGN PATENT DOCUMENTS

WO 2016174414 A1 11/2016

OTHER PUBLICATIONS

International Search Report and Written Opinion for PCT Application No. PCT/US2019/013083, dated Mar. 14, 2019, 15 pages.

*Primary Examiner* — David Carroll
(74) *Attorney, Agent, or Firm* — Polsinelli PC

(57) ABSTRACT

An oil well tool operable to be deployed downhole on a production string including a tubular member having a wall extending from a first end to a second end opposite the first end and the wall forming a plurality of apertures. The oil well tool also includes a mesh screen coupled to an inner surface of the wall of the tubular member and covering the plurality of apertures.

10 Claims, 6 Drawing Sheets

(56) References Cited

U.S. PATENT DOCUMENTS

| | | | | |
|---|---|---|---|---|
| 2,835,328 | A * | 5/1958 | Thompson | E21B 7/20 175/21 |
| 5,624,560 | A * | 4/1997 | Voll | B01D 39/12 210/489 |
| 5,937,944 | A * | 8/1999 | Simone | B01D 29/111 166/236 |
| 6,382,318 | B1 * | 5/2002 | Whitlock | B01D 29/111 166/278 |
| 2003/0062162 | A1 | 4/2003 | Middaugh et al. | |
| 2013/0327528 | A1 | 12/2013 | Frost | |

* cited by examiner

OIL WELL TOOL SYSTEM AND APPARATUS

CROSS-REFERENCE TO RELATED APPLICATIONS

This application is a national stage entry of This Preliminary amendment is being filed with the U.S. national stage application of international application number PCT/US2019/013083 filed Jan. 10, 2019, which claims the benefit of U.S. Provisional Application No. 62/615,898, filed Jan. 10, 2018, each of said applications are expressly incorporated herein by reference in their entirety.

FIELD

The present disclosure relates to an oil well tool operable to be deployed on a production string to control a chemical release.

BACKGROUND

Delivery of downhole chemicals have been typically achieved by injecting solid pellets or liquids into the wellbore or dropping a solid compound down the wellbore to freely dissolve within the wellbore.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present inventive concept is not limited to the precise embodiments and features shown. The accompanying drawings, which are incorporated in and constitute a part of this specification, illustrate an implementation of apparatuses consistent with the present concept and, together with the description, serve to explain advantages and principles consistent with the present concept.

DETAILED DESCRIPTION

Figure 1:
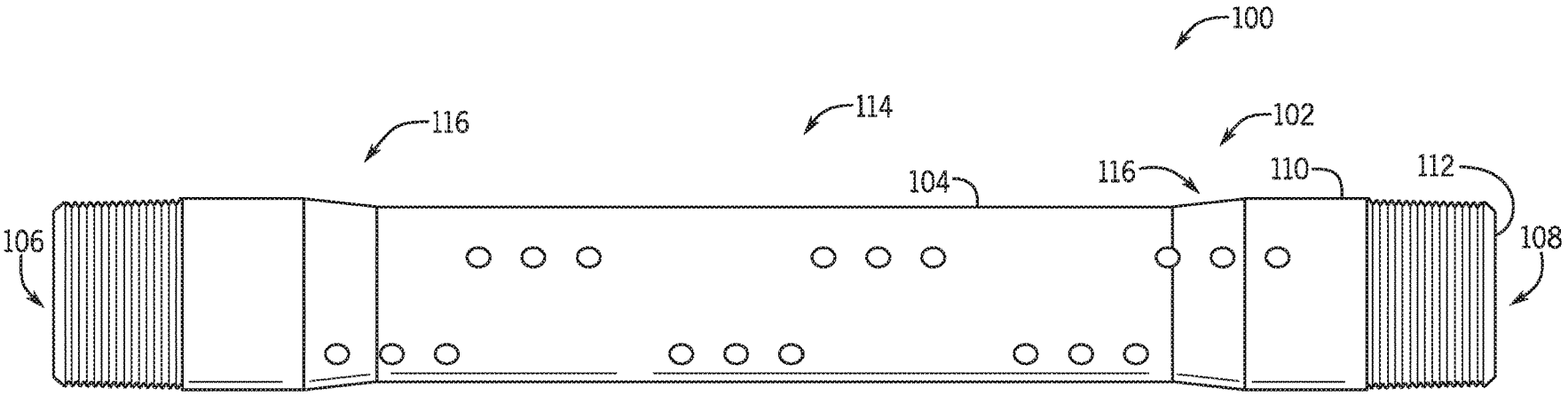
FIG. 1 is a side view of an oil well tool operable to be deployed downhole on a production string.

The present disclosure provides a system and apparatus for an oil well tool operable to control a chemical release in an oil well. The aforementioned may be achieved in an aspect of the present disclosure by providing an oil well tool operable to be deployed downhole on a production string. The oil well tool includes a tubular member having a wall extending from a first end to a second end opposite the first end. The wall forms a plurality of apertures. The tool also includes a mesh screen coupled to an inner surface of the wall of the tubular member and covering the plurality of apertures.

The aforementioned may be achieved in another aspect of the present disclosure by providing a system for controlling a chemical release. The system includes a first tubular member having a wall extending from a first threaded end and a second threaded end opposite the first threaded end and a plurality of apertures positioned between the first threaded end and the second threaded end. The first tubular member includes a cylindrical mesh screen coupled to an inner surface of the wall of the first tubular member and covering the plurality of apertures. The system also includes a second tubular member operable to be coupled to the first tubular member. The second tubular member includes a microencapsulated chemical composition stored therein, wherein the microencapsulated chemical composition is in fluid communication with the cylindrical mesh screen such that the chemical composition is passed through the cylindrical mesh screen and the plurality of apertures into a wellbore.

Several definitions that apply throughout this disclosure will now be presented. "Coupled" refers to the linking or connection of two objects. The coupling can be direct or indirect. An indirect coupling includes connecting two objects through one or more intermediary objects. Coupling can also refer to electrical or mechanical connections. Coupling can also include magnetic linking without physical contact. "Substantially" refers to an element essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like. "About" refers to almost, nearly, on the verge of, or without significant deviation from the numeric representation. For example, about 20 can be 20, or a small deviation from 20. The use of relational terms such as, but not limited to, "front," "rear," "underside," "upperside," "top," "bottom," "left," "right," "upper," "lower," "down," "downward," "up," "upward," and "side," are used in the description for clarity in specific reference to the figures and are not intended to limit the scope of the present inventive concept or the appended claims. "Near" refers to a point or position located a short distance away. For example, near an end means that the point or position is located within a short distance from the end but is not at the end itself. "Portion" refers to a part of the whole, or less than the whole. For example, a portion of a circle means not the whole or entire circle, but a piece less than the whole circle.

Generally, a system and apparatus for delivering a chemical composition and controlling a chemical release of the chemical composition in a wellbore is provided. In an example implementation, an oil well tool for delivering a chemical composition to a designated location includes a tubular member having a wall extending from a first end to a second end opposite the first end. The wall forms a plurality of apertures. The oil well tool also includes a mesh screen coupled to an inner surface of the wall of the tubular member and covers the plurality of apertures. A chemical composition is in fluid communication with the mesh screen such that the chemical composition is passed through the cylindrical mesh screen and the plurality of apertures into the wellbore.

FIG. 1 is a side view of an oil well tool 100 operable to be deployed downhole on a production string 608. The oil well tool 100 includes a tubular member 102 having a wall 104 extending from a first end 106 to a second end 108 opposite the first end 106. The tubular member 102 may be made from any solid material including, but not limited to, steel, aluminum, or an alloy. The tubular member 102 further includes an outer surface 110 and an inner surface 112. The inner surface 112 has a substantially uniform inner diameter 200 and the outer surface 110 has a first outer diameter 202 and a second outer diameter 204, wherein the second outer diameter 204 is less than the first outer diameter 202 and larger than the inner diameter 200.

The first end 106 of the tubular member 102 has a first end diameter equal to the first outer diameter 202, the second end 108 has a second diameter equal to the first outer diameter 202, and a portion 114 of the tubular member 102 extending between the first end 106 and the second end 108 has a portion diameter equal to the second outer diameter 204. The tubular member 102 also has a tapered transition portion 116 between the first outer diameter 202 and the second outer diameter 204 near the first end 106 and the second end 108. Additionally, the outer surface 110 of the tubular member 102 may be threaded at the first end 106 and the second end 108. The threaded end 206 may be any size thread. In one example, the threaded end 206 is cut to a 2⅞" external upset end (EUE) thread size.

Figure 2:
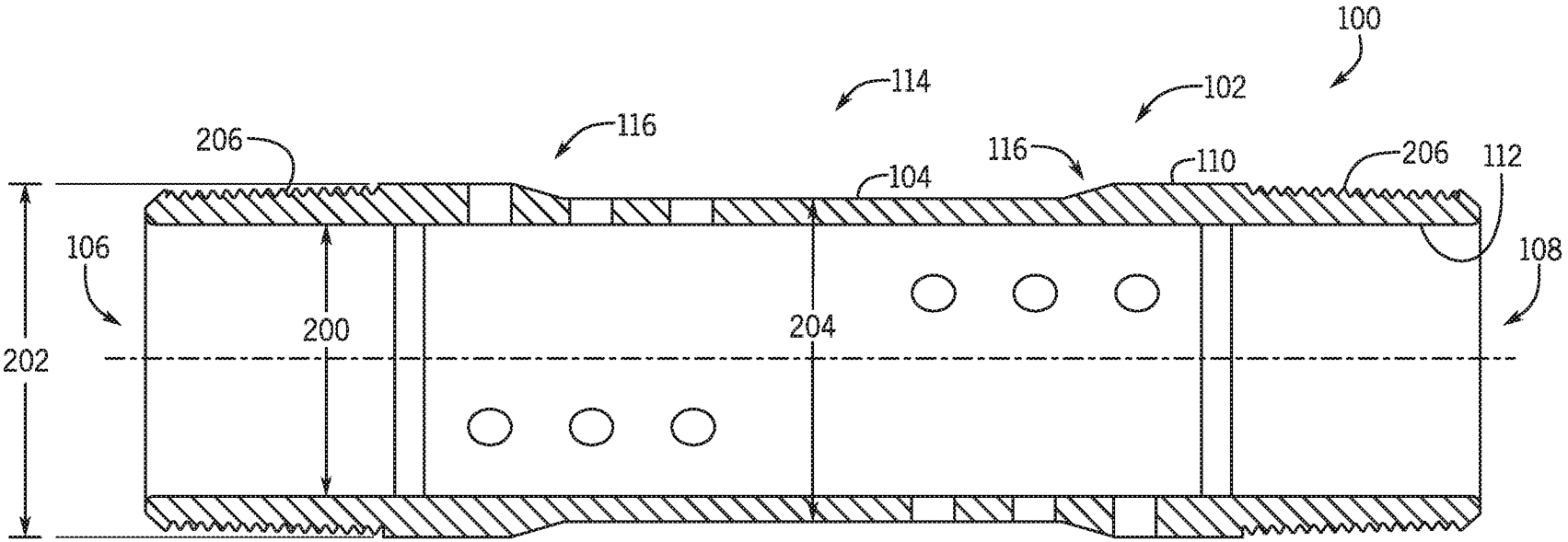
FIG. 2 is a cross-sectional side view of an oil well tool.

FIG. 2 is a cross-sectional side view of an oil well tool 100. The oil well tool 100 is one foot in length, but it is foreseen that the oil well tool 100 can be any length, including two feet in length as shown in FIGS. 3-4. The inner diameter 200 can be 1.380, 1.410, 2.450, 2.482, 2.992, 3.068, 3.476, or 3.548 inches and the first outer diameter 202 can be 2.375, 2.875, 3.156, 3.500, 4.000, or 4.500 inches, although the inner diameter 200 and the first outer diameter 202 may be larger or smaller. The oil well tool 100 may be sized to fit a variety of wellbores and to combine with a variety of production strings 608. For example, the oil well tool 100 may be sized to combine with a standard J-55 joint pipe base.

Figure 3A:
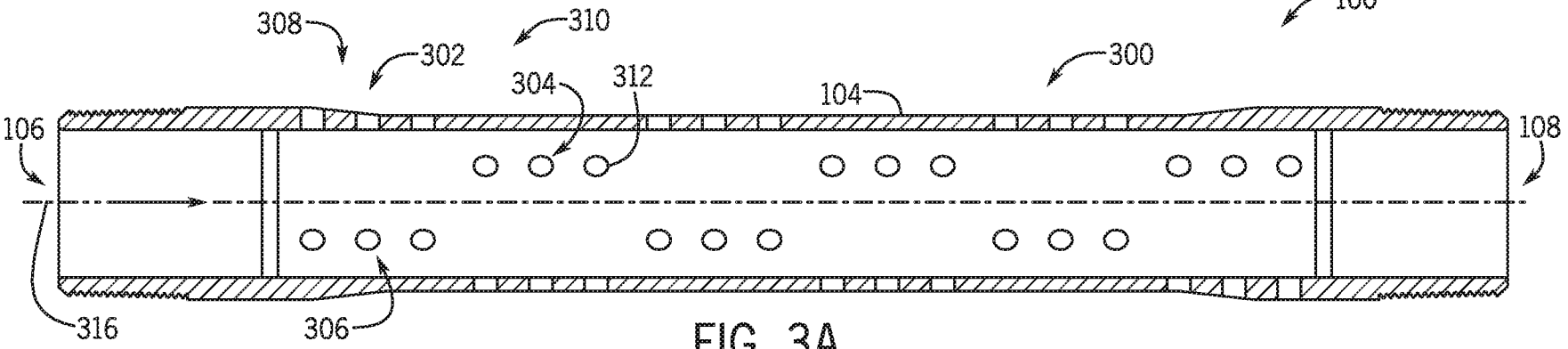
FIG. 3A is a cross-sectional isometric view of another oil well tool.
Figure 3B:
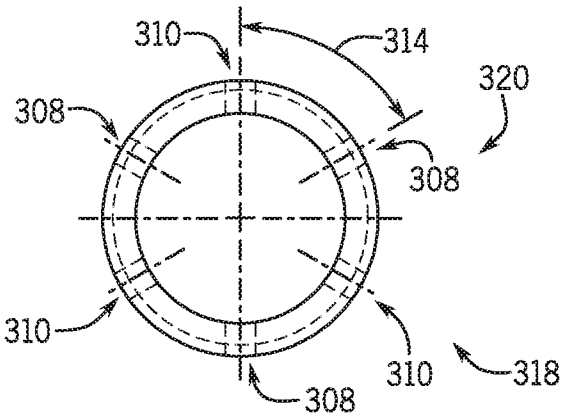
FIG. 3B is a cross-sectional top view of the oil well tool of FIG. 3A.
Figure 4:
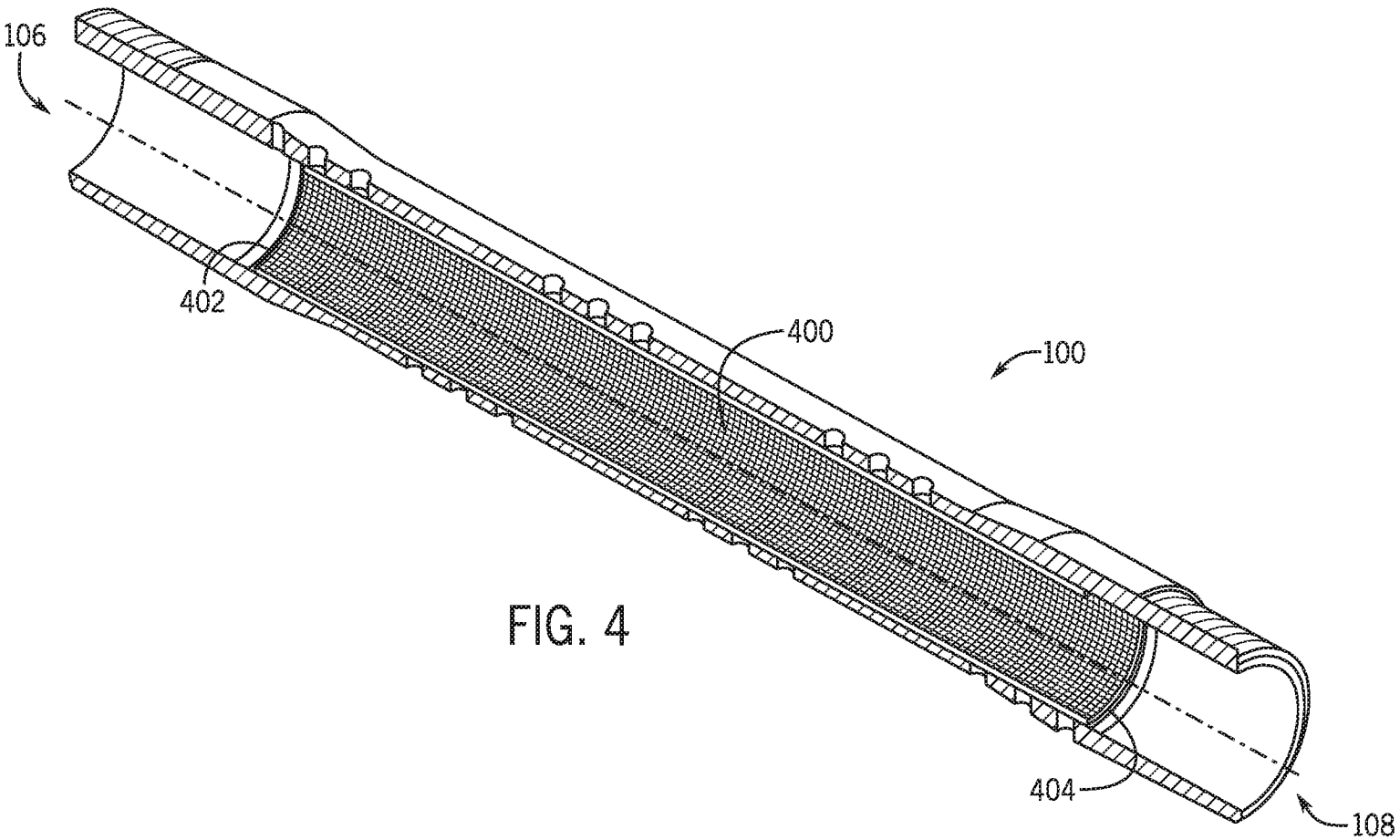
FIG. 4 is a cross-sectional side view of the oil well tool of FIG. 3A with a mesh screen.

FIG. 3A is a cross-sectional side view of another oil well tool 100. FIG. 3B is a cross-sectional top view of the oil well tool 100 of FIG. 3B. The wall 104 of the oil well tool 100 includes a plurality of apertures 300. In one example, each aperture 312 can have a 0.375 inch diameter, but it is foreseen that each aperture 312 may have a different sized diameter and each aperture 312 may have a different sized diameter from each other based on the wellbore characteristics. The plurality of apertures 300 are spaced apart from one another in a repeating pattern. The repeating pattern includes a first set 302 of three adjacent apertures 312 formed a predetermined distance away from the first threaded end 206 in an axial direction 316. In one example, a spacing between each of the three adjacent apertures 312 is 0.906 inches, however, it is foreseen that the three adjacent apertures 312 may have any sized spacing. Other arrangements include having a set of two apertures or a set of four apertures. It is foreseen that each set of apertures 312 can include a different number of apertures 312 from each other and each set can include more than four apertures 312. The arrangement, size, and number of apertures 312 can be adjusted to accommodate a variety of chemical release rates based on the wellbore size.

The plurality of apertures 300 may further include a second set 304 of three adjacent apertures 312 formed a predetermined distance away from the first set 302 of three adjacent apertures 312 in the axial direction 316 and being located at about sixty degrees from the first set 302 of three adjacent apertures 312. It is foreseen that the second set 304 of three adjacent apertures 312 may be located at any angle 314 from the first set 302 of three adjacent apertures 312. The plurality of apertures 300 may also include a third set 306 of three adjacent apertures 312 formed the same predetermined distance away from the first threaded end 206 in the axial direction 316 as the first set 302 of three adjacent apertures 312 and being located at about one-hundred and twenty degrees from the first set 302 of three adjacent apertures 312. It is foreseen that the third set 306 of three adjacent apertures 312 may be located at any angle 314 from the first set 302 of three adjacent apertures 312.

In another implementation, the plurality of apertures 300 may include a first group 320 of three sets 308 of three adjacent apertures 312 formed a predetermined distance away from the first threaded end 206 in the axial direction 316 and a second group 318 of three sets 310 of three adjacent apertures 312 formed a predetermined distance away from the first group 320 in the axial direction 316, wherein each set 308 of the first group 320 are located at about one-hundred and twenty degrees from each other and each set 310 of the second group 318 are located at about one-hundred and twenty degrees from each other and at about sixty degrees from each set 308 of the first group 320. It is foreseen that each set 308 of the first group 320 may be located at any angle 314 from each other and that each set 310 of the second group 318 may be at any angle 314 from each other and/or at any angle 314 from each set 308 of the first group 320. As shown in FIG. 3A, the oil well tool 100 includes eighteen sets of three adjacent apertures 312 extending from the first end 106 to the second end 108, although it is foreseen that the oil well tool 100 may include any number of sets of three adjacent apertures 312. Alternative arrangements of the apertures 312 can be used to adjust the chemical release rate of the oil well tool 100.

FIG. 4 is a cross-sectional isometric view of the oil well tool 100 of FIG. 1 with a mesh screen 400. The mesh screen 400 is coupled to the inner surface 112 of the wall 104 of the tubular member 102 and covers the plurality of apertures 300. It is foreseen that the mesh screen 400 may partially cover the plurality of apertures 300. The mesh screen 400 is tubular with a mesh outer diameter substantially equal to an inner diameter of the wall 104. The mesh screen 400 extends from a portion below the first end 106 to another portion below the second end 108. The mesh screen 400 has a first collar 402 formed at an upstream end and a second collar 404 formed at a downstream end opposite the upstream end. The first collar 402 and the second collar 404 are positioned inside the wall 104 such that the plurality of apertures 300 are spaced between the first collar 402 and the second collar 404. The mesh screen 400 has a size of 10 to 50 mesh, but it is foreseen that the mesh screen 400 may be any other size. The mesh screen 400 is positioned inside the tubular member 102 to protect the mesh screen 400 and enhance the life and performance of the oil well tool 100.

The mesh screen 400 is operable to receive a microencapsulated chemical composition. The microencapsulated chemical composition is in fluid communication with mesh screen 400 such that the chemical composition passes through the cylindrical mesh screen 400 and the plurality of apertures 300 into a wellbore during use. The chemical composition may be liquid chemical treatments for oilfield downhole applications, which are microencapsulated in an organic matrix. The chemical composition may be in the form of a single elongate cylinder that extends along the length of the assembly, or can be a series of cylindrical bodies that are stacked. The release of the chemical composition is controlled by a combination of the microencapsulation of the chemicals and the mesh screen 400. The chemical composition can also be accurately positioned within the wellbore via the oil well tool 100.

Figure 5:
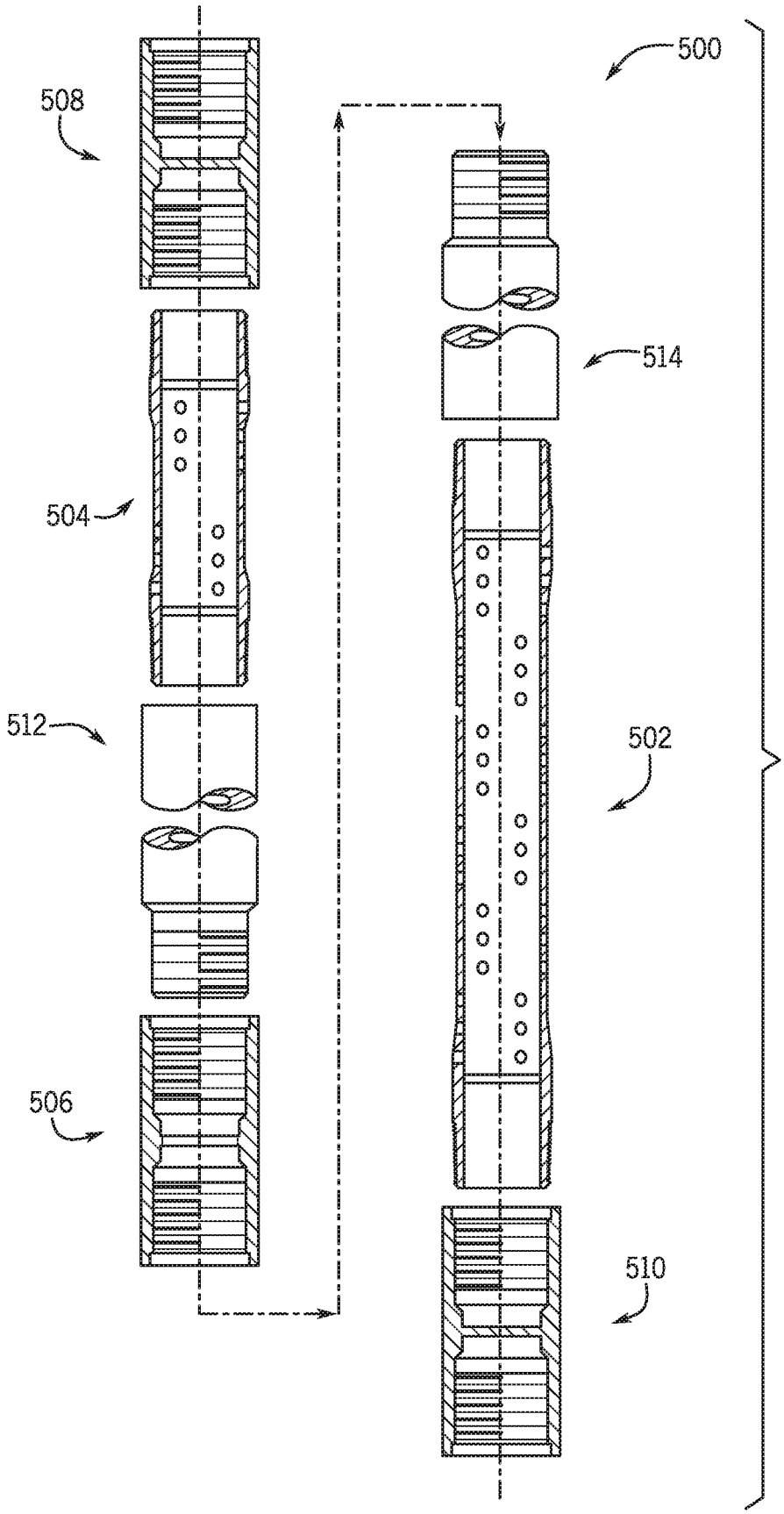
FIG. 5 is a side cross-sectional exploded view of an oil well tool system.

FIG. 5 is a side cross-sectional exploded view of an oil well tool system 500. The system 500 includes a first tubular member 502 and a second tubular member 504 having the same features as the oil well tool 100 as described above. The system 500 also includes a threaded collar 506 having a through opening formed therein, wherein the threaded collar 506 is internally threaded on a downhole end and an upstream end, the downhole end operable to be coupled to the first tubular member 502 and the upstream end operable to be coupled to the second tubular member 504. The system further includes a plug collar 508 having a plug operable to prevent fluids to flow through the threaded collar 506, wherein the plug collar 508 is operable to be coupled to the second tubular member 504 at an end opposite to the end coupled to the threaded collar 506. The plug collar 508 is also operable to be connected to the production string 608. The system 500 also includes a bull plug 510 located at the most downhole position. In one example, the chemical composition is housed in the first tubular member 502 while the second tubular member 504 provides venting to help eliminate and prevent a vacuum from occurring within the system 500. The system 500 may also include a first joint pipe 512 and a second joint pipe 514. The first joint pipe 512 is coupled to the second tubular member 504 and the threaded collar 506 and the second joint pipe 514 is coupled to the threaded collar 506 and the first tubular member 502. The first joint pipe 512 and the second joint pipe 514 provides for extensions in the length of the system 500 as needed, and maybe be any length and size to accommodate the needs of the system 500.

In another example not shown, the system 500 can include a first tubular member and a second tubular member coupled to the first tubular member. The system can further include a third tubular member operably coupled to the second tubular member via a threaded collar and a fourth tubular member coupled to the third tubular member. The system can also include a plug collar coupled to the fourth tubular member and the production string 608 and a bull plug located at the most downhole position. The first, second, and third tubular members each have a wall forming a plurality of openings and an internal mesh screen coupled to an inner wall portion. A microencapsulated chemical composition may be housed in any combination of first, second, and third tubular members. It is foreseen that more than three tubular members having a wall forming a plurality of openings and an internal mesh screen coupled to an inner wall portion can be used to increase the service life of the tool or to release more than one microencapsulated chemical composition.

Figure 6:
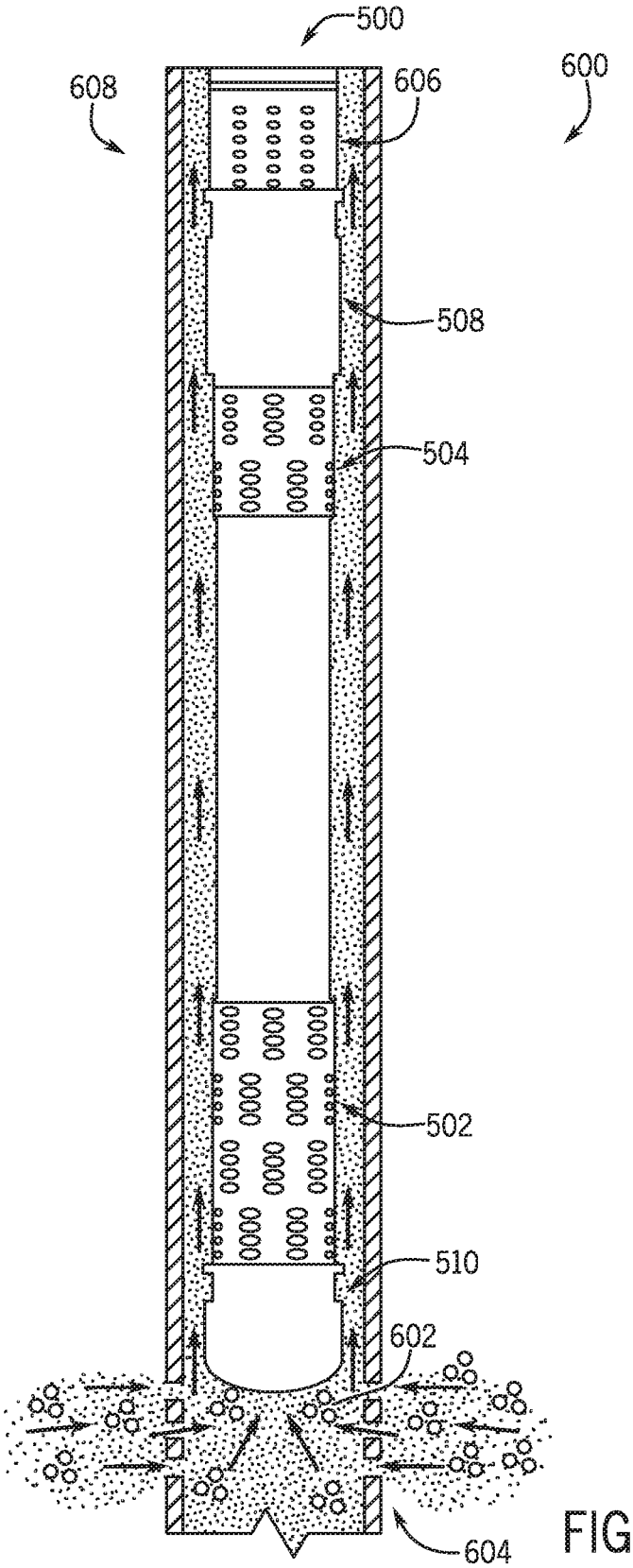
FIG. 6 is a side view of an oil well tool system in a wellbore.

FIG. 6 is a side view of an oil well tool system 500 in a wellbore 600. A fluid 602 flows up the wellbore 600 from perforations 604 in the wellbore 600 and passes the first tubular member 502 housing the chemical composition, where the fluid 602 is treated with the chemicals released from the chemical composition. The treated fluid 602 then enters production at a perforated sub 606. As previously described, the bull plug 510 and the plug collar 508 contain the chemical composition within the system 500 and the second tubular member 504 provides venting for the system 500 and prevents a vacuum from forming in the system 500. It is foreseen that the oil well tool 100 can be used for other stages of extraction including, but not limited to, stimulation.

The oil well tool apparatus and system provides an assembly and system that is easily used, lightweight, and thus, easy to deploy and operate during production in a wellbore. Further, the controlled and accurate release of chemical compositions provides environmental benefits as the precise amount of chemicals can be released and the unreleased chemical composition can be easily removed by simply removing the oil tool from the wellbore.

The description above includes example systems, methods, and/or techniques, products that embody techniques of the present disclosure. However, it is understood that the described disclosure may be practiced without these specific details.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. An oil well tool operable to be deployed downhole on a production string comprising:

a tubular member having a wall extending from a first end to a second end opposite the first end, the wall forming a plurality of apertures; and a mesh screen coupled to an inner surface of the wall of the tubular member and covering the plurality of apertures, wherein the mesh screen is tubular with a mesh outer diameter substantially equal to an inner diameter of the wall, wherein the mesh screen extends from a portion below the first end to another portion above the second end, wherein the tubular member includes an outer surface that has a first outer diameter and a second outer diameter, wherein the second outer diameter is less than the first outer diameter and larger than the substantially uniform inner diameter, wherein the tubular member includes a tapered transition portion between the first outer diameter and the second outer diameter, wherein the wall of the tubular member forms a number of the plurality of apertures in the tapered transition portion.

2. The oil well tool of claim 1, wherein the mesh screen has a first collar formed at an upstream end and a second collar formed at a downstream end opposite the upstream end and the first collar and the second collar are positioned inside the wall such that the plurality of apertures are spaced between the first collar and the second collar.

3. The oil well tool of claim 1, wherein the mesh screen has a mesh size of 10-50 mesh.

4. The oil well tool of claim 1, wherein the inner surface has a substantially uniform inner diameter.

5. The oil well tool of claim 4, wherein the first end of the tubular member has a first end diameter equal to the first outer diameter, the second end has a second end diameter equal to the first outer diameter, and a portion of the tubular member extending between the first end and the second end has a portion diameter equal to the second outer diameter.

6. The oil well tool of claim 5, wherein the outer surface at the first end and the second end are threaded.

7. An oil well tool operable to be deployed downhole on a production string comprising:

a tubular member having a wall extending from a first end to a second end opposite the first end, the wall forming a plurality of apertures; and a mesh screen coupled to an inner surface of the wall of the tubular member and covering the plurality of apertures, wherein the mesh screen is tubular with a mesh outer diameter substantially equal to an inner diameter of the wall, wherein the mesh screen extends from a portion below the first end to another portion above the second end, wherein the plurality of apertures are spaced apart from one another in a repeating pattern, the repeating pattern having a first set of three adjacent apertures formed a predetermined distance away from the first end in an axial direction, a spacing between each of the three adjacent apertures of the first set being substantially 0.906 inches.

8. The oil well tool of claim 7, wherein the plurality of apertures further comprising a second set of three adjacent apertures formed a predetermined distance away from the first set of three adjacent apertures in an axial direction and being located at about sixty degrees from the first set of three adjacent apertures.

9. The oil well tool of claim 8, wherein the plurality of apertures further comprising a third set of three adjacent apertures formed the same predetermined distance away from the first threaded end in the axial direction as the first set of three adjacent apertures and being located at about one-hundred and twenty degrees from the first set of three adjacent apertures.

10. An oil well tool operable to be deployed downhole on a production string comprising:

a tubular member having a wall extending from a first end to a second end opposite the first end, the wall forming a plurality of apertures; and a mesh screen coupled to an inner surface of the wall of the tubular member and covering the plurality of apertures, wherein the mesh screen is tubular with a mesh outer diameter substantially equal to an inner diameter of the wall, wherein the mesh screen extends from a portion below the first end to another portion above the second end, wherein the plurality of apertures further comprises a first group of three sets of three adjacent apertures formed a predetermined distance away from the first end in an axial direction and a second group of three sets of three adjacent apertures formed another predetermined distance away from the first group in the axial direction, wherein each set of the first group are located at about one-hundred and twenty degrees from each other and each set of the second group are located at about one-hundred and twenty degrees from each other and at about sixty degrees from each set of the first group.

* * * * *